US006227986B1

(12) United States Patent
Fisher

(10) Patent No.: US 6,227,986 B1
(45) Date of Patent: May 8, 2001

(54) GOLF PUTTER HAVING LAMINATED FACE INSERT WITH SINGLE EXPOSED LAMINATION

(76) Inventor: Dale P. Fisher, 18055 Bushard St., Fountain Valley, CA (US) 92708

( * ) Notice: Subject to any disclaimer, the term of this patent is extended or adjusted under 35 U.S.C. 154(b) by 0 days.

(21) Appl. No.: 09/221,730

(22) Filed: Dec. 28, 1998

(51) Int. Cl.[7] ..... A63B 53/08
(52) U.S. Cl. ..... 473/342; 473/340
(58) Field of Search ..... 473/290, 288, 473/251, 324, 329, 332, 340, 342, 347

(56) References Cited

U.S. PATENT DOCUMENTS

| | | | | |
|---|---|---|---|---|
| 4,804,188 | * | 2/1989 | McKee et al. | 473/342 |
| 5,255,918 | * | 10/1993 | Anderson et al. | 473/342 |
| 5,921,871 | * | 7/1999 | Fisher | 473/329 |
| 5,924,939 | * | 7/1999 | Grace et al. | 473/324 |

* cited by examiner

*Primary Examiner*—Kien T. Nguyen
(74) *Attorney, Agent, or Firm*—William L. Chapin

(57) ABSTRACT

A golf putter in which both the tactile response and ball launching characteristics may be independently varied over relatively wide respective ranges includes a head in the face of which is formed a stepped cross-section cutout portion which receives a stepped cross-section insert. The putter head includes an outer insert lamination which fits into a complementarity-shaped front recessed portion of the cutout, the outer lamination having an outer generally flat face flush with the front face of the head. Inwards of the recessed portion of the cutout in the front face of the putter head is a pocket adapted to receive and enclose from exterior exposure an inner insert lamination. The outer insert lamination has an outer surface which affords a desired tactile response to a golfer upon impacting a golf ball, while the inner insert lamination has a weight, weight distribution, and resilience which may be varied independently from the properties of the front lamination to achieve desired ball impacting characteristics.

15 Claims, 5 Drawing Sheets

GOLF PUTTER HAVING LAMINATED FACE INSERT WITH SINGLE EXPOSED LAMINATION

BACKGROUND OF THE INVENTION

A. Field of the Invention

The present invention relates to golf clubs. More particularly, the invention relates to an improved golf putter having a laminated face insert in which only a single lamination thereof is exposed.

B. Description of Background Art

In recognition of problems encountered with controlling the direction and speed of golf balls putted toward the hole on a golf course green, the present inventor disclosed a novel golf putter design for improving putting skills in U.S. Pat. No. 5,458,332, Golf Putter Head With A Cushioning Face, issued Oct. 17, 1995. That patent disclosed golf putters in which the heads of the putters were provided with a face insert comprising a polymer pad having a rebound factor directly related to the distance to an intended target, i.e., the hole. For short putts and/or fast greens, a low rebound factor of say 12.5% was disclosed as being desirable for putts of about 10 feet, 25% for 15–20 foot putts, 33.5% for putts of about 30 feet, and 50% for putts of 40 feet or greater. According to the invention, the precise value of selected rebound factor would of course be a matter of personal choice, as long as putters having higher rebound factors are selected for longer putts and/or slow greens.

In U.S. Pat. No. 5,674,132, issued Oct. 7, 1997, the present inventor disclosed further improvements in golf clubs, in which the rebound factor and hardness of woods and irons as well as putters could be independently varied over a wider range to achieve selected ball propulsion distances and feel.

In co-pending U.S. patent application Ser. No. 08/944,080, filed Oct. 4, 1997, the present inventor disclosed a Golf Putter Head With Interchangeable Rebound Control Insert. In that patent application, putters were disclosed in which the heads were provided with interchangeable rebound control inserts, each consisting of a front rebound control pad made of a resilient material, and a rear fastener plate. A recess having a uniform height and extending inward from the front face of the putter receives the insert. The insert is secured to the body of the head by screws which are inserted through holes which extend through the body and the bottom wall of the recess, the screws threadably engaging blind threaded holes in the rear surface of the insert.

The present invention was conceived of to provide an improved golf putter provided with a laminated face insert in which only an outer, ball-contacting lamination thereof is exposed, thereby allowing an inner portion of the insert to have a thickness, shape, and material properties which may all differ from those of the outer lamination.

OBJECTS OF THE INVENTION

The object of the present invention is to provide a golf putter having a head which includes a face insert, in which only the face, upper and lower sides of an outer portion of the insert are exposed.

Another object of the invention is to provide a golf putter head which includes an insert having an outer portion which is exposed and an inner portion which is enclosed within a pocket in the head.

Another object of the invention is to provide a golf putter head which includes a laminated face insert in which only the outer lamination of the insert is exposed.

Another object of the invention is to provide a golf putter head including a body having in the front face thereof a front recess which holds the front lamination of a laminated insert, and a pocket rearward of the recess which encloses and secures the rear potion of the laminated insert, the material properties of the front lamination and rear portion of the insert providing in combination with the body desired composite hardness and weight characteristics.

Another object of the invention is to provide a golf putter head having in the front face thereof a recess which receives a selected one of a plurality of laminated inserts secured to the head by fastening means, each insert having an exposed outer lamination of a fixed thickness and backed by one or more inner laminations enclosed with a pocket inward the recess.

Another object of the invention is to provide a golf putter head including a body having in the front face thereof an interchangeable laminated impact control insert in which only the front lamination thereof is exposed, thereby providing a single interfacial joint between the insert and the upper and lower surfaces of the putter head.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved golf putter in which the head of the putter is of a novel construction and receives a ball-impacting insert of improved design.

According to the present invention, a putter head is provided in which the front face thereof has a cutout portion that includes a recess having a uniform transverse cross section, the recess extending perpendicularly rearwardly or inwardly from the front ball-impacting face of the head. The recess is located at the intended ball-impacting region of the club head face, and is adapted to conformally receive the front or outer portion of an insert having the same outline shape as that of the recess. Rearward of the recess is located a shallow, trough-shaped pocket having a pair of laterally opposed side walls coextensive with the side walls of the recess. The pocket is of the same width as the recess, having laterally opposed side walls which are coplanar, inward extensions of the recess side walls. However, the height of the pocket is less than that of club head face and recess. Thus, a pair of horizontally disposed, rectangular cross section upper and lower ribs running between the lateral side walls of the recess comprise the upper and lower side walls of the pocket. The upper and lower surfaces of the upper and lower ribs, respectively, are co-extensive with the respective upper and lower surfaces of the club head. Thus constructed, the cutout portion of the front face of the putter head is adapted to receive an insert having a front portion or lamination of a fixed thickness which fits conformally within the recess portion of the cutout, with the lower or inner surface of the front lamination of the insert resting on the ribs, and the front surface of the lamination flush with the uncut portion of the club head face adjacent the recess. The insert has a rear portion consisting of an inner lamination or backing plate of smaller vertical extent than the front lamination of the insert, the rear portion being received in the pocket rearward of the recess. The insert is secured to the putter head by fastening means attached to the backing plate. In a preferred embodiment, the backing plate is releasably fastened to the putter head by a pair of screws which protrude forward through holes extending forward from the rear wall of the head through the bottom wall of the pocket, the screws being tightened into a pair of laterally opposed threaded holes provided in the rear surface of the backing plate.

The combination of the novel insert with the complementarily-shaped cutout in the putter head face provides an insert putter head construction in which only the front portion of an insert is exposed, allowing the rear portion or backing plate of the insert structure to be made of different materials and shapes, without altering the appearance of the putter. Moreover, containing the interface plane between the front lamination and backing plate within the pocket, rather than exposing the interface, minimizes the likelihood of delaminating the insert by accidental impact, and affords an aerodynamically smooth construction.

The front or outer lamination of the insert structure according to the present invention is made of a first material which provides desired ball-impacting properties. Thus, the outer lamination is preferably made of a material of a hardness that provides a desired feel when a golf ball is impacted by the club. According to the present invention, the rear portion or backing plate of the insert structure may have a shape and material composition different than that of the front lamination, to provide a desired weight distribution which depends mainly upon the characteristics of the rear portion of the insert rather than the front lamination. Thus, the insert structure preferably has a rear lamination or backing plate which fits into the pocket rearward of the recess, and which is made of a material which may be lighter or heavier than the front lamination of the insert structure Although the backing plate is preferably made of a material such as a metal which is harder and more rigid than the front lamination, it may also be made of other materials to provide a different head weight distribution, weight, or tactile response. Also, the rear portion or backing plate of the insert structure may have a non-homogeneous structure, as long as it fits in the pocket. Thus, the rear backing portion, backing plate or lamination of the insert may have center or outer portions of different densities or weights than other portions of the rear lamination. Moreover, the rear backing plate may have a heterogeneous structure, consisting of laminations made of different materials and/or shapes, to achieve a desired weight distribution and other ballimpacting characteristics.

DESCRIPTION OF THE PREFERRED EMBODIMENTS

FIGS. 1–12 illustrate golf club putter heads having a laminated face insert with single exposed lamination according to the present invention.

Figure 1:
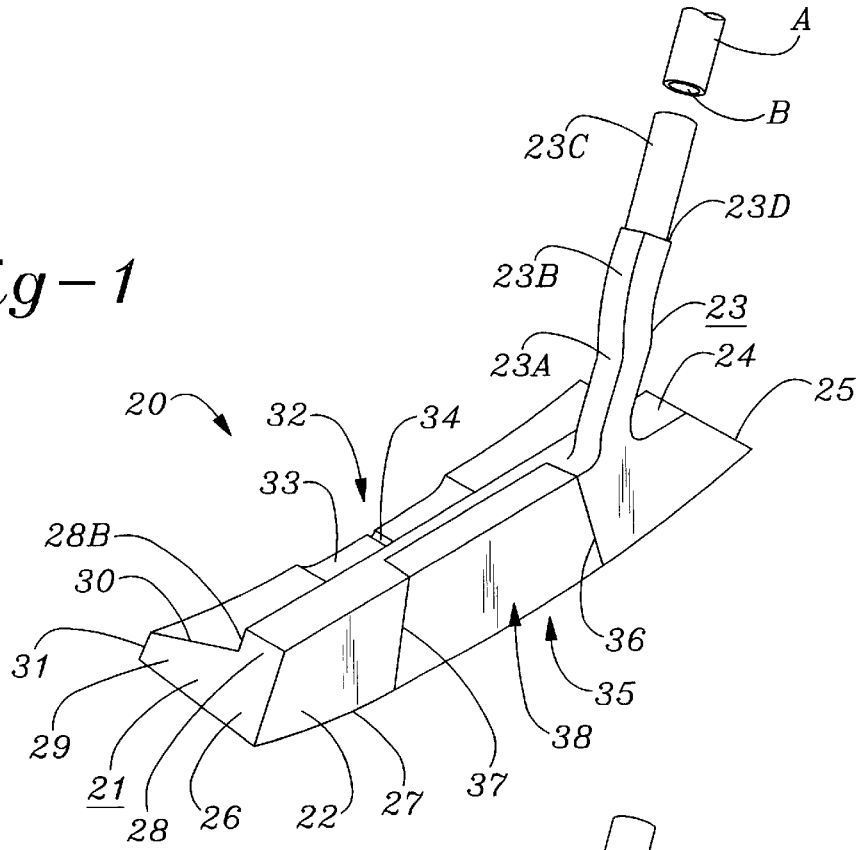
FIG. 1 is an upper perspective view of a golf club putter head having a laminated face insert with single exposed lamination according to the present invention.

Referring now to FIG. 1, a golf club putter head 20 according to the present invention is shown. Putter head 20 may be attached to shaft A, shown fragmentarily in FIG. 1, by conventional means to comprise a complete golf putter.

As shown in FIG. 1, golf club putter head 20 according to the present invention includes a horizontally elongated body 21 having a generally flat, generally vertically disposed front face 22 adapted to impact a golf ball. Putter head body 21 has an elongated, generally cylindrically-shaped shank or hosel 23 that protrudes upward 14 from the upper wall 24 of the body. As shown in FIG. 1, shank 23 joins upper wall 24 of body 21 at a location offset laterally outwards from the center of front head face 22, near the angled right-hand side wall 25 of the body. As is also shown in FIG. 1, in front elevation view, shank 23 has a lower portion 23A that protrudes generally vertically upward 14 from upper wall 24 of body 21, and intermediate and upper portions 23B and 23C, respectively, that angle laterally away from a vertical center line through the body.

Figure 3:
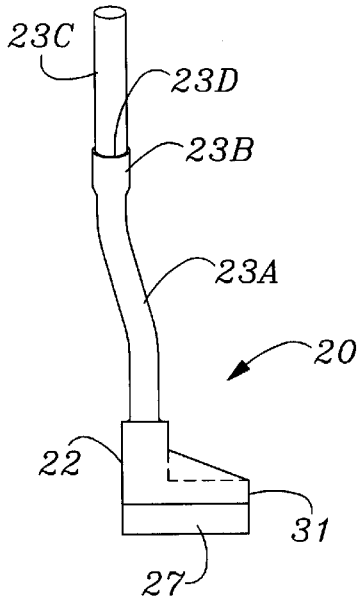
FIG. 3 is a right side elevation view of the putter head of FIG. 1.

As may be seen best by referring to FIG. 3, in side elevation view, lower portion 23A of shank 23 angles sinuously forward of front face 22 of putter head body 21, while intermediate portion 23B of the shank bends rearward to join upper portion 23C, the latter two portions lying in a laterally disposed vertical plane.

As shown in FIGS. 1 and 3, upper portion 23C of shank 23 has a circular cross section which is adapted to be invertably received within the bore of tubular putter shaft A. Preferably, upper cylindrical portions 23C of shank 23 is of smaller diameter than the adjacent part of intermediate portion 23B of the shank, and is joined thereto by an annular shoulder 23D. Shoulder 23D provides a seating surface for the lower annular wall surface B of putter shaft A.

As may be seen best by referring to FIG. 1, body 21 of putter head 20 has a flattened, convexly curved lower wall surface 27. As shown in FIG. 1, putter head body 21 has an upper laterally disposed rectangular transverse cross section rib portion 28 that protrudes downwards from upper wall surface 24 of the body. Also, the rear portion of body 21 includes a trapezoidal transverse cross section portion 29 having an angled wall surface 30 that intersects rear wall 28B of rib portion 28 below upper surface 24, the angled wall sloping downwards and rearwards to intersect back vertical wall surface 31 of the body. As may be seen best by referring to FIGS. 1 and 6, a laterally, medial portion of trapezoidal portion 29 of putter head body 21 is cut downwards from angled wall 30 to form a notch 32. The lower wall surface 33 of notch 32, which forms with lower wall surface 27 of body 21 a thick web, preferably has marked thereon a longitudinally disposed indicator or index line 34. Index line 34 is parallel to and midway between right and left side walls 25 and 26 of body 21. Thus, index line 34 signifies to a golfer the ideal spatial orientation of the putter head velocity vector with respect to a golf ball impacted by the head.

Figure 2:
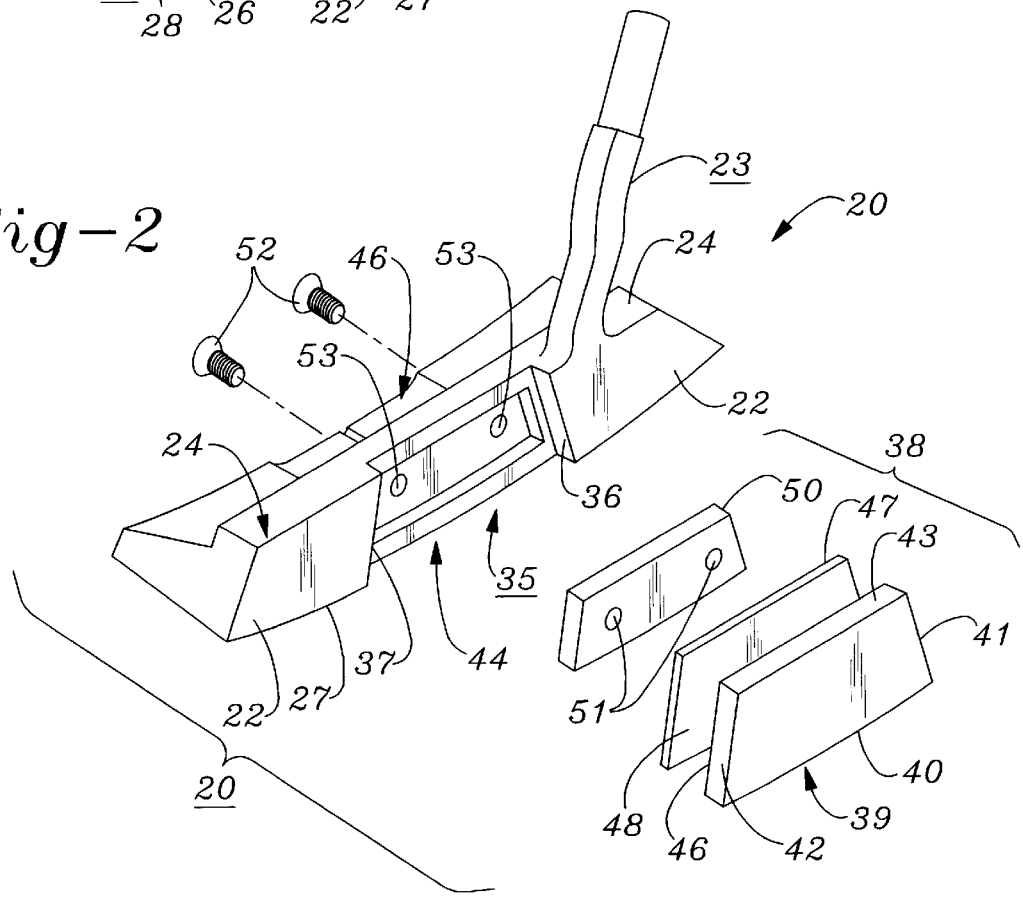
FIG. 2 is an exploded front perspective view of the putter head of FIG. 1.

Referring now primarily to FIGS. 1 and 2, but also to FIGS. 3–9, the novel construction and function of putter head 20, which incorporates a laminated face insert having a single exposed lamination, will now be described in detail.

As shown in FIGS. 1 and 2, front face 22 of putter head body 21 has formed therein a notched or cutout portion that includes recess 35 which extends perpendicularly inwards or rearwards into the body. Recess 35 has a uniform transverse cross section, shaped like a wedge or trapezoid. Thus, recess 35 has angled straight right and left side walls 36 and 37 which penetrate lower wall surface 27 of club head body 21, forming a thin, laterally elongated rectangularly-shaped opening 44 in the lower wall surface. Side walls 36 and 37 of recess 35 angle inwards towards a vertical center line of the recess, and extend upwardly towards upper wall surface 24 of body 21. Side walls 36 and 37 penetrate upper wall surface 24, forming therein a thin, laterally elongated rectangularly-shaped opening 45. As shown in FIGS. 1 and 2, right and left side walls 36 and 37 of recess 35, in combination with those portions of upper wall 24 and convexly curved lower wall 27 that are pierced by the recess, form a generally trapezoidal shape, modified by a convexly curved base. As may be seen best by referring to FIGS. 1 and 4, side walls 36 and 37 of trapezoidally-shaped recess 35 are spaced equidistant from a vertical longitudinally disposed center plane passing through index line 34 in rear notch 32 of body 21. Recess 35 is adapted to receive and hold the front lamination 39 of an insert 38, as will be described below.

Referring now to FIGS. 2–5, it may be seen that putter body 21 includes a shallow trough-shaped pocket 60 which is located inwardly or rearward of recess 35. Pocket 60 has a pair of laterally opposed right and left side walls 36A, 37A which are coextensive with the inner ends of recess side walls 36 and 37. Therefore, the lateral extent or width of pocket 60 is the same as that of recess 35. However, the height of pocket 60 is less than that of recess 35, as will now be explained.

Figure 5:
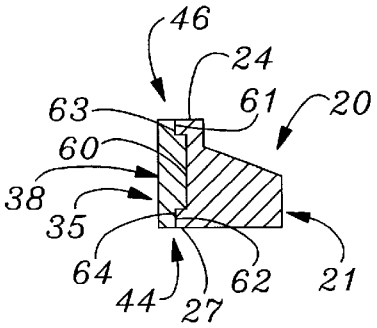
FIG. 5 is a transverse sectional view of the head of FIG. 4, taken along line 5—5.
Figure 4:
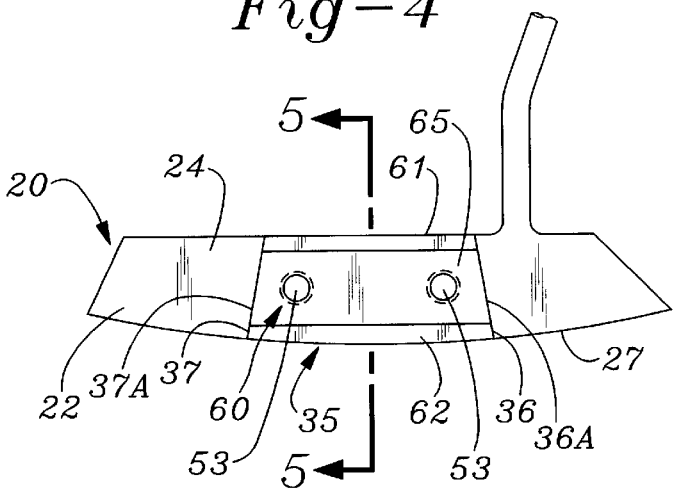
FIG. 4 is a fragmentary front plan view of the club head of FIG. 2, showing the insert thereof removed.
Figure 17A:
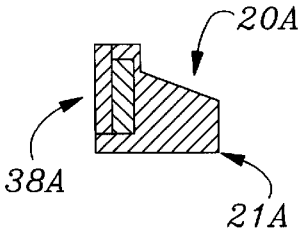
FIG. 17 is a transverse sectional view of the modified putter heads of FIG. 16.
Figure 17D:
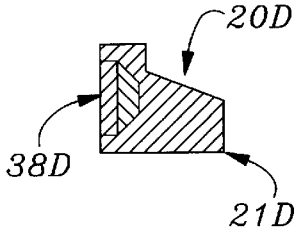

As may be seen best by referring to FIGS. 4 and 5, a pair of laterally disposed upper and lower ribs 61 and 62, respectively, limit the vertical span of pocket 60 so that the pocket does not penetrate either upper side wall 24 or lower side wall 27 of putter head body 21. Ribs 61 and 62 are generally straight and of rectangular cross section, and are disposed between side walls 36 and 37 of recess 35. As shown in FIGS. 4 and 5, the upper surface of upper rib 61 is coextensive with upper wall surface 24 of putter head body 21, and the lower surface of lower rib 62 is coextensive with lower wall surface 27 of the putter head body. Ribs 61 and 62 have coplanar outer surfaces 63 and 64, respectively, which lie in a vertical plane parallel to in and inward of front face 22 of putter head body 21. As shown in the figures, pocket 60 preferably has a generally flat inner wall surface 65 which is also parallel to front face 22 of putter head body 21. However, inner wall surface 65 could be contoured to conformally receive contoured parts of a rear portion of insert 38, if desired.

Figure 8:
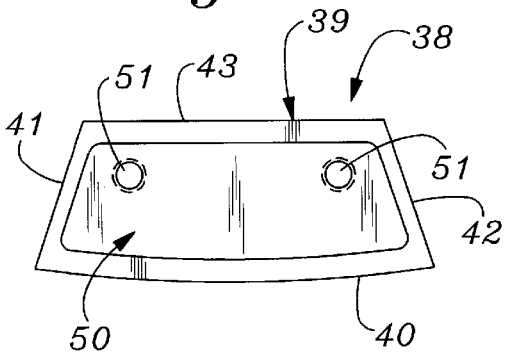
FIG. 8 is a rear elevation view of a laminated face insert comprising part of the golf club putter head of FIG. 1.
Figure 9:
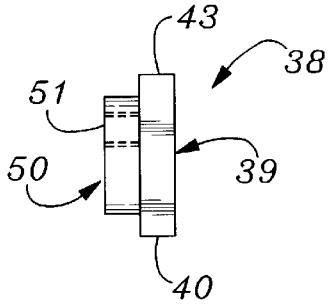
FIG. 9 is a side elevation view of the insert of FIG. 8.

Referring now to FIGS. 2, 8 and 9, it may be seen that the cutout portion of putter head body is constructed to conformally receive a face insert 38 having a flat front portion 39 and rear portion 50 of smaller vertical extent. As shown in the figures, front portion 39 of insert 38 has a plan view shape complementary to that of recess 35. Thus, front portion 39 of insert 38 has a horizontally disposed, slightly convexly curved lower base wall 40 and straight right and left side walls 41 and 42 which angle inwardly and extend upwards to a straight, horizontally disposed upper edge wall 43.

Referring still to FIGS. 2, 8 and 9, it may be seen that insert 38 includes a rear portion 50 which has a smaller vertical extent than that of front portion 39 of the insert, thus allowing the rear portion to be received in pocket 60. As shown in FIGS. 1 and 5, this construction allows insert 38 to be installed in putter head body 21 with front portion 39 of the insert fitting conformally within recess 35, with rear surface 46 of the front insert portion seated on outer surfaces 63 and 64 of upper and lower ribs 61 and 62, respectively, and with rear portion 50 of the insert fitting within pocket 60. This novel design permits front end rear portions 39 and 50 of insert 38 to be made of different materials, and have different shapes, while exposing only surfaces of outer portion 39 of the insert. Thus, front portion 39 of insert 38 may have material properties chosen to produce a desired tactile response upon impacting the golf ball, while rear portion 50 may have a shape and composition different from those of the front portion, to permit independent variability of other characteristics affecting the trajectory of an impacted golf ball, such as weight distribution and/or rebound factor of the putter.

In preferred embodiments of golf putter heads according to the present invention, insert 38 has a laminated construction, in which front portion 39 of the insert is fabricated as a thin pad or lamination of the proper size and thickness to fit conformally within recess 35, while rear portion 50 of the insert consists of lamination which has different material properties than the front lamination, the rear lamination incorporating means for fastening the insert to putter head body 21. Thus, as shown in FIGS. 2, 8 and 9, insert 38 preferably has a trapezoidally-shaped front lamination or face pad 39 of generally uniform thickness adapted to fit conformally within putter head face recess 35. Front lamination 39 of insert 38 has a horizontally disposed, slightly convexly curved base wall 40, and straight right and left side walls 41 and 42 which angle inwardly and extend upwardly to a straight, horizontally disposed upper edge wall 43. Front lamination 39 of insert 38 is fabricated from a material which provides a desired tactile response feedback to the golfer upon impacting a golf ball. To achieve this response, the material from which front lamination 39 is fabricated may be selected from a wide variety of materials to suit the wishes of a particular golfer. Such materials include metals, woods, and other natural and synthetic materials including polymers such as polyurethane, balata and epoxy, as well as composites of the aforementioned materials, to yield desired ball traction, feel, and launching properties.

As shown in FIGS. 2, 8 and 9, insert 38 also includes a rear lamination 50 of uniform thickness which is shaped like a trapezoid of less height than that of front lamination 39, thus adapting the rear lamination to fit conformally within pocket 60 located inwardly or rearwardly of the outer faces of ribs 61 and 62 which form the inner or rear seating plane of recess 35 for front lamination 39. Rear insert lamination 50 has a thickness no greater than the depth of pocket 60, so that it may fit all the way rearward into the pocket. As shown in FIGS. 2, 8 and 9, rear lamination 50 has formed through its thickness dimension a pair of laterally spaced apart, threaded screw holes 52A for fastening the rear lamination to putter head body 21, in a manner which will be described below.

Rear lamination 50 is preferably made of a rigid material, including metals, such as steel, zinc or brass. In a preferred embodiment of insert 38, front lamination 39 of insert 38 is secured to rear lamination 50 by an adhesive layer 47 between inner, or rear flat wall surface 46 of the front lamination and front wall surface 48 of the rear lamination. In example embodiments of insert 38, adhesive layer 47 consisted of a double-sided adhesive tape strip, coated on both sides with a pressure sensitive adhesive. In this embodiment, adhesive layer strip 47 is sandwiched between front lamination 39 and rear lamination 50, and the sandwich squeezed to adhere the front and rear laminations together.

Figure 6:
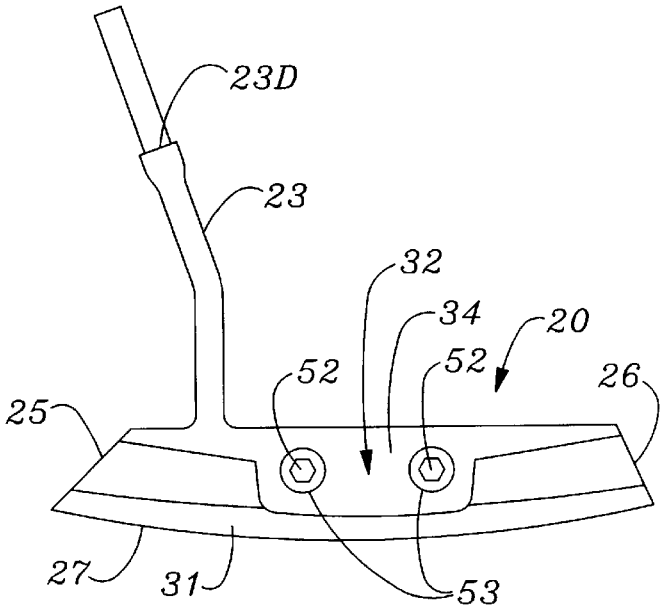
FIG. 6 is a rear elevation view of the putter head of FIG. 1.
Figure 7:
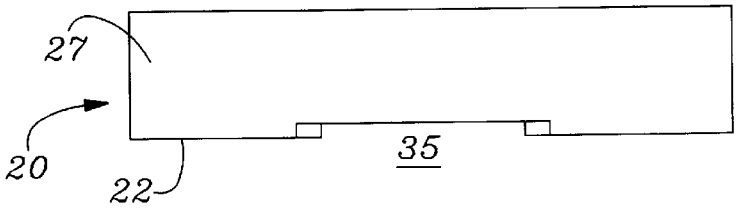
FIG. 7 is a bottom plan view of the putter head of FIG. 1.

As may be seen best by referring to FIGS. 1, 2 and 6, insert 38 is releasably secured to putter head body 21 by a pair of headed screws 52 inserted through a pair of longitudinally disposed, laterally spaced apart holes 53 which extend through rib section 28 of putter head body 21. Screws 52 are threadingly secured by and tightened into threaded backing plate holes 52A, thereby securing insert 38 in recess 35 of putter head 20. With this construction, putter head 20 may be constructed to receive an interchangeable insert 38 having particular rebound, hardness, weight distribution and tactile response characteristics, and may be replaced by another insert having different desired characteristics by simply loosening screws 52, removing the insert, and replacing it with a different insert.

In example embodiments of insert 38, front lamination 39 had a thickness of about one-eighth (1/8) inch, while rear lamination 50 had a thickness of about three thirty-seconds (3/32) inch. Front lamination 39 of insert 38 is preferably constructed of a material that has a hardness less than that of the remainder of club head body 21, which is typically made of cast metal or hard, dense wood. Since the size, shape, material composition, and weight distribution of rear lamination 50 may be significantly different than the corresponding characteristics of front lamination 39, the feel and ball handling characteristics of putter 20 may be varied over a much larger range than achievable with prior art putters provided with multi-lamination inserts. Moreover, this large range of variability is achieved without exposing the interface between the front face insert lamination with the rear lamination. From an aesthetic standpoint, this novel construction results in a pleasing appearance, with a single face insert lamination exposed to view. Moreover, the absence of any exposed joints between laminations of insert 38 according to the present invention minimizes the likelihood of accidently nicking or partially de-laminating the insert.

Figure 11:
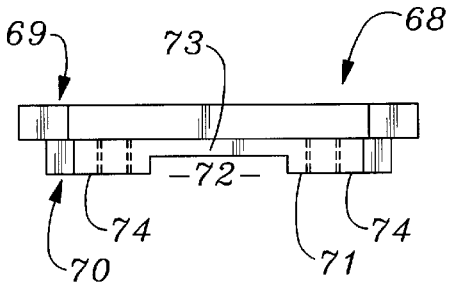
FIG. 11 is an upper elevation view of the modified insert of FIG. 10.
Figure 10:
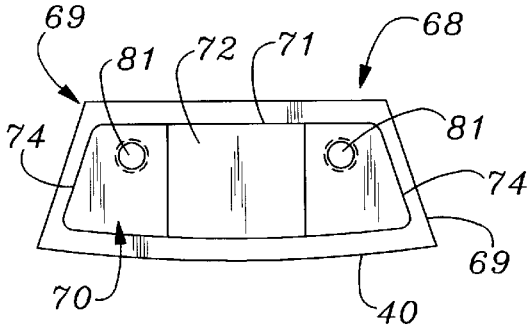
FIG. 10 is a rear elevation view of a first modification of the insert of FIG. 8.

FIGS. 10 and 11 illustrate a first modification of insert 38. As shown in FIGS. 10 and 11, modified insert 68 has a front lamination 69 substantially similar to front lamination 39 of insert 38 shown in FIGS. 1–9 and described above. Modified insert 68 also has a rear lamination 70 similar in construction to rear lamination 50 of insert 38. However, modified rear insert lamination 70 has a laterally centrally located section of reduced thickness. Modified rear insert lamination 70 has formed in the rear wall surface 71 thereof a rectangular cross section groove or notch 72 which spans the height of the insert. Thus constructed, rear insert lamination 70 has a centrally located, relatively thin, plate-like rectangular portion 73, joined at opposite lateral sides thereof by relatively thicker trapezoidally-shaped boss sections 74 in which are formed threaded fastening holes 81. This construction of modified rear insert lamination 70 results in the weight of the central portion of insert 68 being less than outer portions, as desired by some golfers. In addition to providing a modified weight distribution, the central lateral portion 73 may be made sufficiently thin to allow it to flex elastically. By this means, the rebound factor of insert 68 may be varied over a relatively wide range, and independently of the characteristics of front insert lamination 69.

Figure 13:
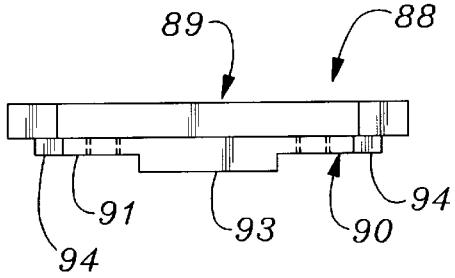
FIG. 13 is an upper elevation view of the modified insert of FIG. 12.
Figure 12:
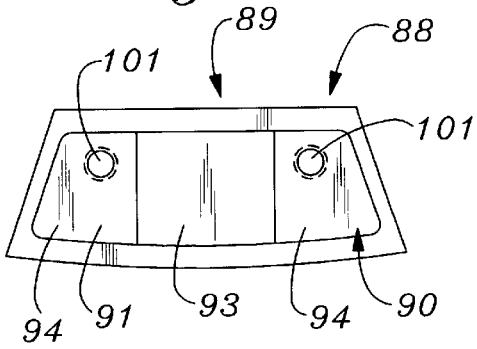
FIG. 12 is a rear elevation view of a second modification of the insert of FIG. 8.
Figure 16A:
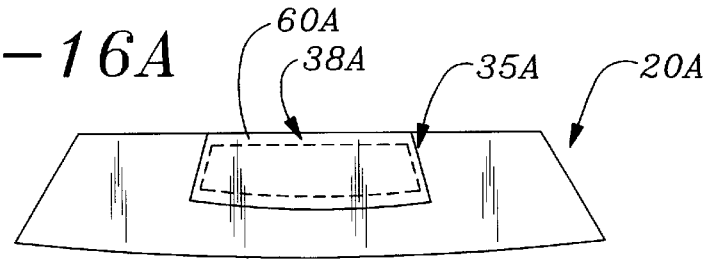
FIG. 16 is a front elevation view of additional modifications of the putter head of FIG. 1, in which the shape and location of the insert and recess thereof are varied.
Figure 16B:
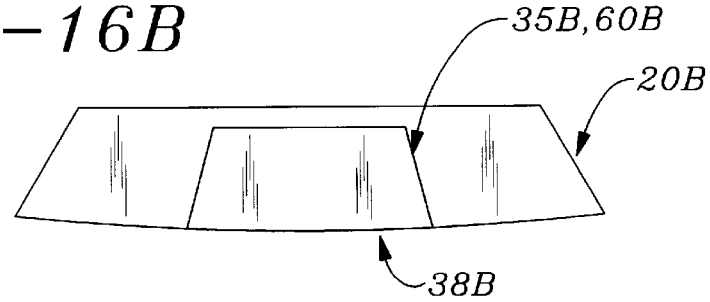
Figure 16C:
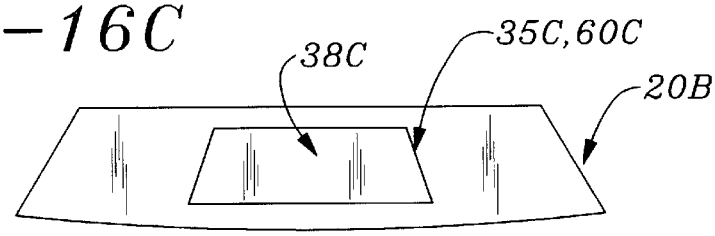
Figure 16D:
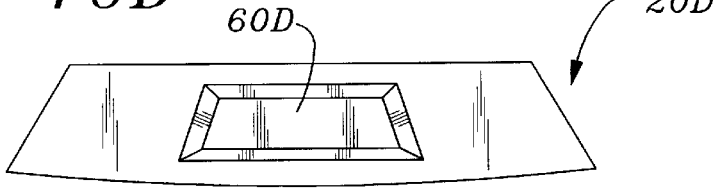
Figure 16E:
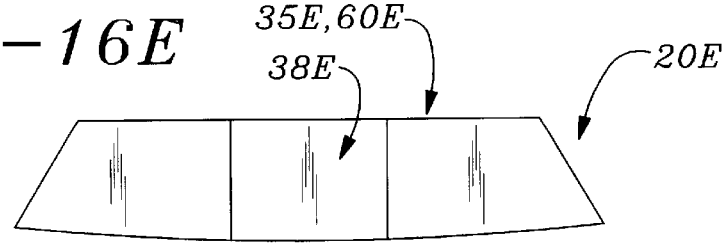

FIGS. 12 and 13 illustrate another modification of insert 38. As shown in FIGS. 12 and 13, modified insert 88 includes a front lamination 89 and a rear lamination 90 which has a laterally centrally located section of greater thickness than the outer lateral portions of the insert lamination. Thus, as shown in FIGS. 12 and 13, rear lamination 90 of modified insert 88 has a relatively thick, rectangularly-shaped central portion 93 which protrudes rearwardly from the rear surface 91 defined by the front surfaces of laterally adjacent mounting tab sections 94 in which are formed threaded fastening holes 101. This construction causes the weight distribution of modified insert 88 to be concentrated near the lateral center line of the insert, as desired by some golfers.

Figure 14:
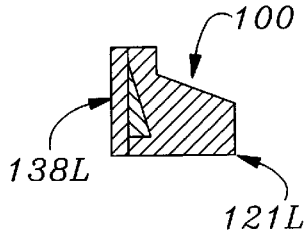
FIG. 14 is a transverse sectional view of a modification of the putter head of FIG. 5, in which the weight of the head is concentrated near the lower portion thereof.
Figure 17B:
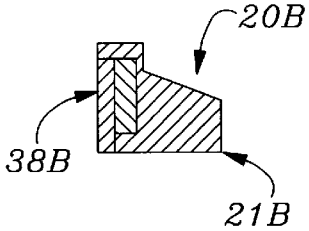
Figure 17C:
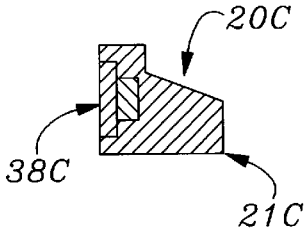
Figure 15:
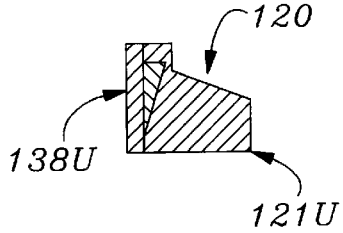
FIG. 15 is a transverse sectional view of another modification of the putter head of FIG. 5, in which the weight of the head is concentrated near the upper portion thereof.

FIGS. 14 and 15 illustrate two other modifications 100 and 120 of golf putter head 20, in which the weight distribution of inserts 138L, 138U is concentrated near the lower and upper portions of the head 121L, 121U, respectively, to suit the desires of some golfers.

FIGS. 16 and 17 are front elevation and transverse sectional views, respectively, of other modifications of putter head 20. Thus, FIGS. 16A and 17A illustrate a modified putter head 20A according to the present invention, in which the front portion of the insert 38A thereof is fitted in modified recess 35A and pocket 60A, and penetrates only the upper wall surface of the putter head body. Similarly, FIGS. 16B and 17B illustrate a modified putter head 20B in which the front portion of the insert penetrates only the lower surface of the putter head body. FIGS. 16C and 17C illustrate a modified putter head 20C in which only the front face of the insert is exposed. FIGS. 16D and 17D illustrate a modification of putter head 20C, in which the pocket thereof has sloping side walls, rather than being of uniform transverse cross section. Of course, the previously described embodiments and modifications thereof may optionally also employ a pocket having inwardly or outwardly diverging side walls, to impart different desired weight distribution and ball impacting properties to a putter head according to the present invention. FIG. 16E illustrates a modified putter head 20E having an insert 38E with parallel vertical side walls.

What is claimed is:

1. A golf puker including an elongated shaft having at a first end thereof a hand grip and at a second end thereof a head for impacting a golf ball, said head comprising;

a. a body having a front face with an intended region for impacting a golf ball, said front face having therein a cutout portion including a front inwardly protruding recess having a pair of laterally opposed side walls and a pocket which protrudes inwardly from an inner vertically disposed surface of said recess, and having upper and lower laterally disposed walls formed by the lower and upper surfaces, respectively, of a pair of vertically opposed, laterally disposed upper and lower elongated ribs, said ribs having upper and lower surfaces contigious with said upper and lower surface of said body, b. an inset for providing said putter with ball impacting properties different from those provided by said body without said recess and insert, said insert having a front ball impacting portion having an outline shape complementary to that of said recess and adapted to fit therein with a front surface of said insert substantially flush with said front face of said body and a rear surface adapted to seat on outer surfaces of said ribs, and a plate-like rear portion having a non-uniform weight per unit area adapted to fit into said pocket, and c. means for fastening said insert to said body, said fastening means including in combination at least one threaded hole extending forward from a rear surface of said rear portion of safe insert, and a threaded member which extends forward through an aperture provided through a rear wall surface of said body into said pocket, said threaded member being tightened into said threaded hole.

2. The golf putter of claim 1 wherein said recess is further defined as penetrating said lower wall surface of said body.

3. The golf putter of claim 1 wherein said recess is further defined as penetrating said upper wall surface of said body.

4. The golf putter of claim 1 wherein said recess is further defined as penetrating both said upper and lower wall surfaces of said body.

5. The golf putter of claim 1, wherein a laterally intermediate region of said rear portion of said insert is further defined as being lighter than outer lateral portions of said rear portion of said insert.

6. The golf putter of claim 5 wherein said laterally intermediate region of said rear portion of said insert is further defined as being thinner than said outer lateral portions of said rear portion of said insert.

7. The golf putter of claim 1 wherein a laterally intermediate region of said rear portion of said insert is further defined as being heavier than outer lateral portions of said rear portion of said insert.

8. The golf putter of claim 7 wherein said laterally intermediate region of said rear portion of said insert is further defined as being thicker than said outer lateral portions of said rear portion of said insert.

9. The golf putter of claim 1 wherein said front and rear portions of said putter have a different material composition.

10. The golf putter of claim 1 wherein said weight per unit area of a lower portion of said rear portion of said insert is greater then an upper portion thereof.

11. The golf putter of claim 1 wherein said weight per unit area of an upper portion of said rear portion of said insert is greater than a lower portion thereof.

12. A golf putter including an elongated shaft having at a first end thereof a handgrip and at a second end thereof a head for impacting a golf ball, said head comprising;

a. a body having a front outer face with an intended region for impacting a golf ball, said front face thereof having formed therein a depression including an outer recess having laterally opposed side walls, and a pocket inward of said depression of smaller vertical height than said body, said pocket protruding inwardly from a generally vertically disposed inner wall surface of said recess, said pocket having a pair of laterally disposed side walls coextensive with said recess side walls, and having upper and lower laterally disposed walls formed by the lower and upper surfaces, respectively of a pair of vertically opposed, laterally elongated and disposed upper and lower ribs, said ribs having upper and lower surfaces contguos with said upper and lower wall surfaces of said body, b. an insert for providing said putter with desired ball impacting properties, said insert having a front ball-impacting portion having an outline shape complementary to the trace of said recess in said front face of said body and adapted to fit conformally therein with an outer surface of said insert substantially flush with said front face of said body, and an inner surface of said front portion of said insert seated on said inner wall surface of said recess, said insert having a rear plate-like portion having a non-uniform cross-sectional shape adapted to be received in said pocked, said front and rear portions of said insert comprising individual laminations adhered together, and c. means for fastening said insert to said body.

13. The golf putter of claim 12 wherein said means for fastening said insert to said body includes in combination at least one threaded hole protruding forward from a rear surface of said rear portion of said insert, a hole which protrudes forward from a rear wall surface of said body through an inner wall surface of said pocket, and a threaded member disposed through said body hole and tightened into said threaded hole.

14. A golf putter head for providing selectable ball impacting properties comprising;

a. a laterally elongated body having a generally flat front face with an intended region for impacting a golf ball, said front face thereof having formed therein a depression having a front recess having laterally opposed side walls cut inwardly from said front face to a first, inner seating surface, and a pocket cut inwardly from said first, inner seating surface, b. an insert for providing said putter with desired ball impacting properties, said insert having an outer, ball-impacting lamination having a desired hardness and an outline shape complementary to the trace of said recess in said front face of said body and adapted to fit conformally therein with an outer, front surface of said outer lamination substantially co-planar with said front face of said body, an inner surface of said outer lamination seated on said first, inner seating surface of said recess, and an inner, trajectory-determining insert lamination adapted to be received within said pocket, and c. means for fastening said insert to said body, said fastening means including in combination at least one threaded hole extending forward from a rear surface of said rear portion of said insert, and a threaded member which extends forward through an aperture provided through a rear wall surface of said body into said pocket, said threaded member being tightened into said threaded hole.

15. The golf putter head of claim 14 wherein said fastening means affords a capability for interchangeably installing selected inserts in said head.

* * * * *